US010330391B2

(12) United States Patent
Tranier et al.

(10) Patent No.: US 10,330,391 B2
(45) Date of Patent: Jun. 25, 2019

(54) HEAT EXCHANGER ASSEMBLY

(71) Applicant: L'Air Liquide, Societe Anonyme pour l'Etude et l'Exploitation des Procedes Georges Claude, Paris (FR)

(72) Inventors: Jean-Pierre Tranier, L'Hay-les-Roses (FR); Marc Wagner, Saint Maur des Fosses (FR)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 412 days.

(21) Appl. No.: 14/428,862

(22) PCT Filed: Sep. 9, 2013

(86) PCT No.: PCT/FR2013/052168
§ 371 (c)(1),
(2) Date: Mar. 17, 2015

(87) PCT Pub. No.: WO2014/044979
PCT Pub. Date: Mar. 27, 2014

(65) Prior Publication Data

US 2015/0233645 A1 Aug. 20, 2015

(30) Foreign Application Priority Data

Sep. 19, 2012 (FR) ..... 12 58783

(51) Int. Cl.
*F28D 9/00* (2006.01)
*F25J 5/00* (2006.01)
*F25J 3/04* (2006.01)

(52) U.S. Cl.
CPC ..... *F28D 9/005* (2013.01); *F25J 3/04236* (2013.01); *F25J 5/002* (2013.01); *F28D 9/0093* (2013.01);

(Continued)

(58) Field of Classification Search
CPC ..... F25J 2290/42; F28D 9/0093; F28F 3/025
See application file for complete search history.

(56) References Cited

U.S. PATENT DOCUMENTS 1,875,128 A * 8/1932 Patterson et al. ..... F28D 9/0068 165/140
3,256,704 A * 6/1966 Becker ..... B01D 1/22 165/166

(Continued)

FOREIGN PATENT DOCUMENTS

| | | |
|---|---|---|
| FR | 2 844 040 | 3/2004 |
| WO | WO 2007 149345 | 12/2007 |
| WO | WO 2007/149345 | 12/2007 |

OTHER PUBLICATIONS

International Search Report and Written Opinion for PCT/FR2013/052168, dated Nov. 26, 2015.

*Primary Examiner* — Allen J Flanigan
(74) *Attorney, Agent, or Firm* — Justin K. Murray

(57) ABSTRACT

The invention relates to a heat exchanger assembly having two exchangers, each comprising a stack of parallel plates defining a first connection surface and a second connection surface that are adjacent to each other. The heat exchanger assembly can also include an enclosure between the first connection surface and the second connection surface, primary compartments in the enclosure configured to channel primary fluid through the first connection surface and the second connection surface, and a secondary compartment in the enclosure for channeling secondary fluid.

16 Claims, 4 Drawing Sheets

(52) U.S. Cl.
CPC ..... *F25J 2290/32* (2013.01); *F25J 2290/40* (2013.01); *F25J 2290/44* (2013.01)

(56) References Cited

U.S. PATENT DOCUMENTS

| | | | | | |
|---|---|---|---|---|---|
| 3,266,568 | A * | 8/1966 | Butt et al. | F25J 5/002 | 165/166 |
| 3,552,488 | A * | 1/1971 | Grill et al. | F28D 9/0025 | 165/165 |
| 3,759,322 | A * | 9/1973 | Nasser et al. | F25J 5/00 | 165/166 |
| 3,860,065 | A * | 1/1975 | Schauls | F25J 5/002 | 165/166 |
| 4,116,271 | A * | 9/1978 | De Lepeleire | F28D 9/0006 | 165/166 |
| 5,029,639 | A * | 7/1991 | Finnemore et al. | F28D 9/0025 | 165/165 |
| 6,393,864 | B1 * | 5/2002 | Darredeau | F28F 27/02 | 62/643 |
| 6,834,515 | B2 * | 12/2004 | Sunder et al. | F25J 5/002 | 165/133 |
| 2003/0041619 | A1 | 3/2003 | Lu | | |
| 2007/0289726 | A1 | 12/2007 | Jibb et al. | | |
| 2007/0295027 | A1 | 12/2007 | Howard et al. | | |
| 2011/0139417 | A1 | 6/2011 | Godry et al. | | |
| 2012/0096732 | A1 * | 4/2012 | TeGrotenhuis | F26B 23/005 | 34/82 |

* cited by examiner

HEAT EXCHANGER ASSEMBLY

CROSS REFERENCE TO RELATED APPLICATIONS

This application is a § 371 of International PCT Application PCT/FR2013/052168, filed Sep. 19, 2013, which claims the benefit of FR1258783, filed Sep. 19, 2012, both of which are herein incorporated by reference in their entireties.

TECHNICAL FIELD OF THE INVENTION

The present invention relates to a heat exchanger assembly, intended to form a heat transfer unit without contact between a primary fluid and a secondary fluid, for example a cryogenics-based gas separation unit. Moreover, the present invention relates to a cryogenics-based gas separation installation comprising such a heat exchanger assembly.

The present invention is notably applicable in the field of gas separation, for example air separation, by cryogenics.

BACKGROUND

In the prior art, a cryogenics-based air separation unit generally comprises main heat exchangers with brazed plates which form the main heat exchange line of the cryogenics-based air separation unit.

These heat exchanges place in a heat-exchange relationship, on the one hand, air at room temperature and, on the other hand, cryogenic fluids coming from one or more distillation columns. At the output of such a heat exchanger, the air has a temperature of the order of −175° C., whereas the reheated fluids are roughly at room temperature (approximately 25° C.). Therefore the thermal gradient is approximately 200 K between the input and the output of a heat exchanger and the mean logarithmic temperature deviation is between 2 K and 10 K.

Each heat exchanger comprises a stack of parallel plates delimiting fluid passages, and spacers or heat exchange waves defining channels for these fluids. Peripheral closure bars ensure the seal-tightness of the fluid passages.

As is known per se, such a heat exchanger is overall in the form of a rectangular parallelepiped. The length of such a heat exchanger is typically from 4 to 8 m, its width from 1 to 1.5 m and its height from 1 to 2 m.

By convention, the length of a heat exchanger is the largest dimension of the parallel plates delimiting the fluid passages. The width of a heat exchanger is measured at right angles to the length. The height of a heat exchanger is measured in the direction of stacking of its plates.

Moreover, it is also known practice to increase the height of such a heat exchanger by assembling, for example by welding side-by-side, a number of separately-brazed exchangers, something which is not possible for increasing the length or the width.

The state of the art for such heat exchangers is to produce a counter-current heat exchange with a direction of flow of fluids in the lengthwise direction so as to benefit from the greatest dimension to produce the heat exchange.

FR-A-2844040 proposes using such an exchanger with a direction of flow of the fluids in the widthwise direction so as to considerably reduce (typically by a factor of 4 to 6) the number of exchangers to be arranged in parallel.

Nevertheless, to be able to achieve a thermal gradient of the order of 200 K with a low temperature difference and the most efficient exchange spacers-waves (for example so-called serrated waves having a short serration length and a very high density), it is necessary to increase the width of the exchanger to 2.5 m or even 3.5 m. Now, such a width of the exchanger is incompatible with all the existing brazing furnaces. Moreover, increasing the size of the brazing furnace would pose technical feasibility problems.

To remedy this problem, WO-A-2007149345 describes a heat exchanger assembly comprising two juxtaposed heat exchangers. In this case, the number of exchangers to be brazed is reduced only by a factor of 2 to 3, a factor which is all the same very significant.

Furthermore, the heat exchanger assembly of WO-A-2007149345 comprises means for fluidically connecting the juxtaposed heat exchangers. In the case in point, the primary fluid is high-pressure compressed air and the secondary fluid is low-pressure dinitrogen.

However, between the heat exchangers of WO-A-2007149345, the primary fluid is collected by oblique so-called distribution spacers which direct the secondary fluid to two lateral supply boxes (one on each side of the heat exchanger) and which have a small discharge section, which generates significant head losses. Similarly, the primary fluid is supplied to the second heat exchanger by two lateral supply boxes and oblique distribution spacers, which generates significant head losses.

Therefore, to neutralize this increase in the head losses, it would be necessary to increase the exchange sections. However, the dimensions of a heat exchanger are limited by the dimensions of the brazing furnace, in which this heat exchanger is manufactured. Therefore, such a heat exchanger assembly would entail brazing more exchangers and increasing the quantity of material needed to produce them.

SUMMARY OF THE INVENTION

The present invention aims notably to solve, wholly or partly, the abovementioned problems.

To this end, the subject of the invention is a heat exchanger assembly, intended to form a heat transfer unit without contact between a primary fluid and a secondary fluid, the heat exchanger assembly comprising two exchangers, namely a first exchanger and a second exchanger suitable for exchanging heat between at least one primary fluid, for example high-pressure compressed air, and at least one secondary fluid, for example low-pressure dinitrogen, each exchanger comprising a stack of several plates arranged parallel to one another in a so-called stacking direction, so as to delimit at least i) primary passages configured for the flow of primary fluid and ii) secondary passages configured for the flow of secondary fluid, the primary passages and the secondary passages following one another according to a predetermined stacking pattern, the stack of the plates of the first exchanger defining a first connection face fluidically linked to the primary passages of the first exchanger, the stack of the plates of the second exchanger defining a second connection face fluidically linked to the primary passages of the second exchanger;

the heat exchanger assembly being characterized in that the first exchanger and the second exchanger are arranged such that the first connection face is adjacent to the second connection face; and in that it further comprises:

an enclosure delimited by the first connection face, by the second connection face and by an enclosure volume extending between the first connection face and the second connection face, at least one primary compartment arranged in the enclosure volume to channel all or part of the primary fluid between the first exchanger and the second exchanger through the first connection face and the second connection face, at least one secondary compartment which is distinct from said at least one primary compartment and which is arranged in the enclosure volume to channel all or part of the secondary fluid between the first exchanger and the second exchanger through the first connection face and the second connection face.

In other words, the present invention involves increasing the number of primary fluid supply boxes (number strictly greater than 2) by having the primary fluid pass through the same connection face as the secondary fluid.

In the present application, the term "adjacent" denotes an element situated in the vicinity of another element, therefore close to or alongside this other element. In particular, two connection surfaces are adjacent when they are in contact along the respective edges or the respective parts.

In the present application, the term "low-pressure dinitrogen" refers to a fluid which is nitrogen-enriched compared to air and which is produced at a substantially lower pressure than that of the air entering into a heat exchanger.

Typically, the predetermined stacking pattern can comprise an "-S-P-S-" succession with a primary passage "P" surrounded by two secondary passages "S". This stacking pattern is repeated over the entire height of the corresponding heat exchanger.

Alternatively, the predetermined stacking pattern can comprise a succession of one primary passage "P" and one secondary passage "S", the secondary passages being of greater height than the primary passages except for the end secondary passages "S'" so as to avoid unbalancing the heat exchange at the ends. At the ends the pattern of the succession would be: "S'-P-S-P-S-P-S-" and "-S-P-S-P-S".

Thus, the primary and secondary compartment(s) can transfer all the primary fluid and all the secondary fluid from one heat exchanger to the neighboring heat exchanger, through the first connection face and the second connection face. Consequently, such a heat exchanger assembly makes it possible to increase the exchange surface area between the primary and secondary fluids, without modifying the manufacturing tools, in particular the brazing furnaces.

According to a variant of the invention, the enclosure volume is defined by enclosure walls which envelope the enclosure volume.

Thus, such enclosure walls define a sealed or quasi-sealed enclosure volume.

In the present application, the term "quasi-sealed" qualifies a volume for which the leak rate is acceptable, that is to say below 5%, even below 1% of the total volume of incoming fluid.

According to one embodiment of the invention, the first connection face is overall planar and at right angles to said plates of the first exchanger, and the second connection face is overall planar and at right angles to the plates of the second exchanger.

In other words, each exchanger is overall in the form of a rectangular parallelepiped.

Thus, such heat exchangers have forms that are relatively simple to produce.

According to one embodiment of the invention, the first connection face is overall planar and at right angles to said plates of the first exchanger, and the second connection face is overall planar and at right angles to the plates of the second exchanger.

According to one embodiment of the invention, the first connection face and the second connection face are parallel and arranged facing one another.

Thus, such a heat exchanger assembly can be very compact, with a minimal enclosure volume, which makes it possible to reduce the head losses in the flows of the primary and secondary fluids.

According to one embodiment of the invention, the first exchanger and the second exchanger are arranged side-by-side, the first connection face and the second connection face being oriented in respective normal directions which are substantially parallel, the first connection face and the second connection face preferably being arranged so as to present an adjacent or common edge.

In other words, the enclosure is overall in the form of a half-cylinder or half-ring. Thus, such a heat exchanger assembly can have a relatively small dimension in a direction at right angles to the first and the second connection face. Furthermore, this arrangement of the heat exchangers simplifies the manufacturing of the heat exchanger assembly, because there is more space for welding and connecting the heat exchangers.

According to one embodiment of the invention, the first connection face and the second connection face are substantially orthogonal to one another, the first connection face and the second connection face preferably being arranged so as to present an adjacent or common edge.

In other words, the enclosure is overall in the form of a quarter-cylinder or quarter-ring. Thus, such a heat exchanger assembly can have a bulk suited to certain applications. Furthermore, this arrangement of the heat exchangers simplifies the manufacturing of the heat exchanger assembly, because there is more space for welding and connecting the heat exchangers.

According to one embodiment of the invention, the enclosure volume forms the secondary compartment.

Thus, there is no need to provide any specific duct for transporting the secondary fluid, which simplifies the construction of the heat exchanger assembly.

According to a variant of this embodiment, the heat exchanger assembly comprises sealing means between, on the one hand, the enclosure and, on the other hand, the first connection face and the second connection face. Thus, such sealing means guarantee the seal-tightness of the enclosure.

According to one embodiment of the invention, the first connection face is overall in the form of a rectangle whose edges are defined by the length and by the height, in the stacking direction, of the first exchanger, and in which the second connection face is overall in the form of a rectangle whose edges are defined by the length and by the height, in the stacking direction, of the second exchanger.

In other words, each exchanger is overall in the form of a rectangular parallelepiped. Thus, such heat exchangers have forms that are relatively simple to produce.

According to one embodiment of the invention, for each of the exchangers, the length is very much greater, preferably by a factor greater than four, than the height measured in the stacking direction.

Thus, such dimensions make it possible to reduce the number of exchangers.

According to one embodiment of the invention, the primary compartments are formed by primary ducts which each extend between the connection faces and parallel to the stacking direction, the primary ducts being distributed with predetermined intervals, preferably at regular intervals, in a direction that is transversal to the stacking direction, the primary ducts being fluidically connected with the primary passages of each heat exchanger so as to allow the flow of the primary fluid between the exchangers; and each secondary compartment is formed by the walls of the enclosure and by the walls of two successive primary ducts.

Thus, such an arrangement of the primary and secondary compartments makes it possible to limit the number of components to be assembled. Typically, the primary ducts are configured for the flow of a high-pressure fluid, whereas the secondary compartments are used for the flow of a low-pressure fluid.

According to a variant of the invention, the primary ducts comprise: i) a longitudinal manifold of tubular form, preferably of circular section, and ii) primary tubes fluidically linking the manifold to the first connection face and to the second connection face. Thus, such primary ducts make it possible to effectively transfer primary fluid between the first exchanger and the second exchanger.

According to one embodiment of the invention, each primary duct is in the form of a prism with rectangular base or of a cylinder with curvilinear base and whose generatrices are parallel to the stacking direction.

In other words, the walls of the primary ducts are planar and parallel to the stacking direction. Thus, such a rectangular section limits the head losses in the primary and secondary compartments.

According to one embodiment of the invention, each primary duct consists of at least two parts secured together by mechanical securing means, the mechanical securing means preferably being selected from the group consisting of screws, flanges, rivets, crimping elements, embedding elements, snap-fitting elements, shrink-fitting elements and complementary forms such as dovetails.

Thus, such an arrangement makes it possible to obtain an extended exchange surface area, while limiting the head losses induced by changes of direction of flow of the primary and secondary fluids.

According to one embodiment of the invention, in each secondary passage, a blocking member is placed on the respective primary duct so as to prevent the flow of secondary fluid in said primary duct.

Thus, the assembly of the heat exchanger assembly is relatively quick to perform.

According to a variant of the invention, each heat exchanger is overall in the form of a rectangular parallelepiped, and each connection face is overall in the form of a rectangle, said so-called stacking direction being parallel to the height of the rectangular parallelepiped, the spacers extending parallel to the length of the rectangular parallelepiped, and each connection face overall forming a plane which is at right angles to said so-called stacking direction and which is parallel to the length and to the width of the rectangular parallelepiped.

Thus, such a geometry makes it possible to obtain an extended exchange surface area, while limiting the head losses induced by changes of direction of flow of the primary and secondary fluids. Furthermore, such a geometry makes it possible to maximize the dimensions of the exchanger assembly, because it maximizes the occupancy of a brazing furnace.

According to one embodiment of the invention, the primary compartments and the secondary compartments are totally or partially delimited by walls made of flexible material, the flexible material preferably being selected from the group consisting of stainless steel, aluminum, an aluminum alloy and organic materials that are flexible at low temperature, such as polytetrafluoroethylene.

Thus, such flexible walls make it possible to maximize the seal-tightness (hyperstatic system) and to limit the concentrations of stresses on the structure of each heat exchanger, which is particularly significant for large dimensions.

According to one embodiment of the invention, the heat exchanger assembly according to the invention further comprises an additional heat exchanger, called sub-cooler, the sub-cooler being fluidically connected with one of the juxtaposed heat exchangers.

Thus, such a sub-cooler makes it possible to increase the efficiency of the heat exchanger assembly, because it makes it possible to sub-cool the liquids implemented by heat exchange with the residual cold nitrogen at the column output. The direction of flow of the residual nitrogen is the transverse direction, that is to say the direction corresponding to the width of the heat exchanger. For the liquids, the direction of flow can be cross-current or counter-current.

According to one embodiment of the invention, each heat exchanger comprises, on its periphery, primary supply boxes and secondary supply boxes which are configured to introduce or discharge primary fluid or secondary fluid respectively into or out of the primary passages or the secondary passages, the primary supply boxes and the secondary supply boxes preferably being arranged such that the primary fluid flows in the reverse direction to the secondary fluid.

Thus, the primary supply boxes and the secondary supply boxes allow for a so-called "counter-current" heat exchange, which is particularly effective.

According to one embodiment of the invention, each heat exchanger comprises spacers which define primary passages or secondary passages and which are formed by exchange waves of serrated type exhibiting a density per unit length greater than 800 waves per meter, having a serration length less than 5 mm and having a wave height of between 3 m and 20 mm, preferably between 5 mm and 15 mm.

Thus, such spacers confer a high exchange efficiency on the heat exchanger assembly.

According to one embodiment of the invention, each heat exchanger is configured such that the direction of flow of the primary and secondary fluids in each exchanger is a transverse direction extending widthwise in a heat exchanger.

Moreover, the subject of the present invention is a cryogenics-based air separation installation, comprising at least one heat exchanger assembly according to the invention, the primary fluid being high-pressure compressed air, the secondary fluid being low-pressure dinitrogen.

Thus, such a unit makes it possible to separate air by cryogenics in large quantities.

The embodiments of the invention and the variants of the invention mentioned above can be taken in isolation or in any technically possible combination.

BRIEF DESCRIPTION OF THE DRAWINGS

The present invention will be well understood and its advantages will also emerge in light of the following description, given solely as a nonlimiting example and with reference to the attached drawings, in which.

DETAILED DESCRIPTION

Figure 1:
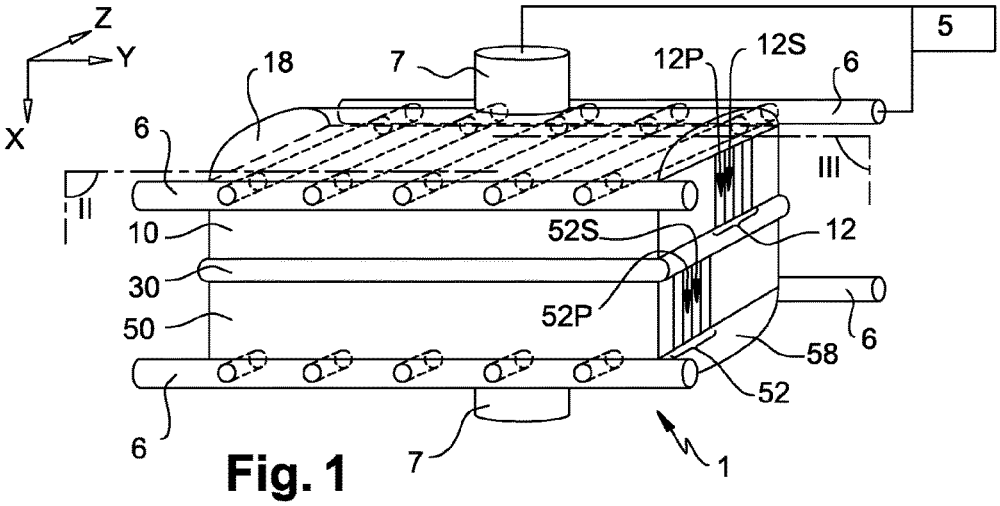
FIG. 1 is a perspective schematic view of a heat exchanger assembly according to a first embodiment of the invention.
Figure 2:
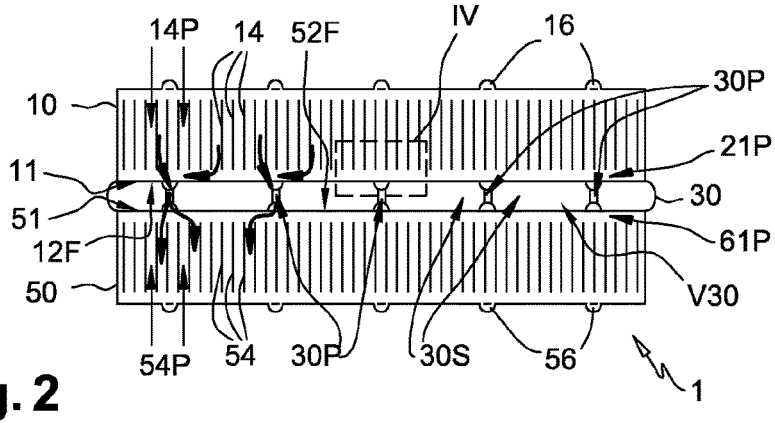
FIG. 2 is a section along the plane II in FIG. 1.
Figure 3:
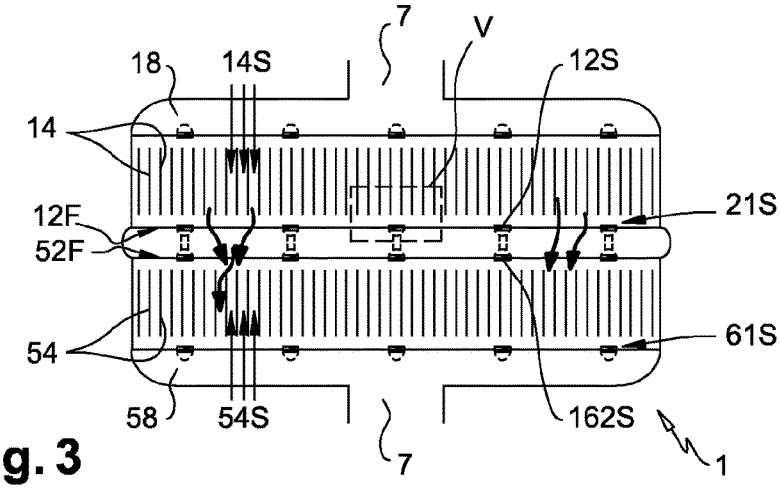
FIG. 3 is a section along the plane III in FIG. 1.

FIGS. 1, 2 and 3 illustrate a heat exchanger assembly 1, for forming a heat transfer unit 5 without contact between a primary fluid and a secondary fluid.

In the example of FIGS. 1 to 3, the unit 5 is intended to be incorporated in a cryogenics-based air separation installation, which comprises the heat exchanger assembly 1, and in which the primary fluid is high-pressure compressed air, and the secondary fluid is low-pressure dinitrogen. The compressed air is the calorigenic fluid and the dinitrogen is the refrigerant. Nevertheless, the primary and secondary fluids could be other fluids, depending on the application of the heat transfer unit.

According to another embodiment of the invention, the heat exchanger assembly comprises several calorigenic fluids and/or several refrigerants.

The heat exchanger assembly 1 comprises two heat exchangers 10 and 50 which are juxtaposed by respective adjacent surfaces 11 and 51. The adjacent surfaces 11 and 51 are planar.

The heat exchanger 10 comprises a stack of several plates, some of which are schematically represented in FIG. 1 with the reference 12. Similarly, the heat exchanger 50 comprises a stack of several plates, some of which are schematically represented in FIG. 1 with the reference 52.

The plates 12 are arranged parallel to one another in a so-called stacking direction Z, so as to delimit i) primary passages 12P configured for the flow of the primary fluid, and ii) secondary passages 12S configured for the flow of secondary fluid. The primary passages 12P and the secondary passages 12S follow one another according to a predetermined stacking pattern (here "-Primary-Secondary-Primary-").

In the example of FIGS. 1 to 3, each primary passage 12P alternates with a secondary passage 12S. Alternatively, the stacking pattern could be of the type comprising two secondary passages surrounding one primary passage ("-Secondary-Primary-Secondary-").

Similarly, the plates 52 are arranged parallel to one another in a so-called stacking direction Z, so as to delimit i) primary passages 52P configured for the flow of the primary fluid, and ii) secondary passages 52S configured for the flow of secondary fluid. The primary passages 52P and the secondary passages 52S follow one another according to a predetermined stacking pattern. In the example of FIGS. 1 to 3, each primary passage 52P alternates with a secondary passage 52S.

The stacking of the plates 12 of the first exchanger 10 defines a first connection face 12F which is fluidically linked to the primary passages 12P of the first exchanger 10. Similarly, the stacking of the plates 52 of the second exchanger 50 defines a second connection face 52F which is fluidically linked to the primary passages 52S of the second exchanger 50.

As is known per se, the heat exchanger 10 or 50 is overall in the form of a rectangular parallelepiped.

Here, the width and the length of the heat exchanger 10 or 50 are measured respectively along the axes X and Y.

In the example of FIGS. 1 to 3, the first connection face 12F and the second connection face 52F are each overall in the form of a rectangle. The first heat exchanger 10 and the second heat exchanger 50 are each overall in the form of a rectangular parallelepiped.

The first exchanger 10 and the second exchanger 50 are arranged such that the first connection face 12F is adjacent to the second connection face 52F. In the example of FIGS. 1 to 3, the first connection face 12F and the second connection face 52F are parallel and arranged facing one another.

The first connection face 12F is overall planar and at right angles to the plates 12 of the first exchanger 10. Similarly, the second connection face 52F is overall planar and at right angles to the plates 52 of the second exchanger 50.

Furthermore, the heat exchanger 10 comprises spacers 14 which extend between the plates 12 so as to define i) primary channels 14P configured for the flow of the primary fluid. Between two other successive plates 12, not in the drawing of FIG. 2, the spacers 14 define ii) secondary channels which are not represented and which are configured for the flow of the secondary fluid. The spacers are usually called exchange waves or "fins".

Similarly, the heat exchanger 50 comprises spacers 54 which extend between the plates 52 so as to define i) primary channels 54P configured for the flow of the primary fluid, or secondary channels which are not represented in the drawing of FIG. 2.

As detailed hereinbelow, the heat exchanger 10 comprises means for fluidically connecting the heat exchangers 10 and 50.

Each heat exchanger 10 or 50 is overall in the form of a rectangular parallelepiped. The stacking direction Z is parallel to the height of the rectangular parallelepiped. The spacers 14 or 54 extend parallel to the length of the rectangular parallelepiped.

The first connection face 12F is overall in the form of a rectangle whose edges are defined by the length, in the longitudinal direction X, and by the height, in the stacking direction Z, of the first heat exchanger 10.

The second connection face 52F is overall in the form of a rectangle whose edges are defined by the length, in the longitudinal direction X, and by the height, in the stacking direction Z, of the second heat exchanger 50.

The first connection face 12F and the second connection face 52F each overall form a planar surface 11 or 51 which is at right angles to the stacking direction Z and which is parallel to the length (direction X) and to the width (direction Y) of the rectangular parallelepiped that the first or second exchanger 10 or 50 forms.

Each heat exchanger 10 or 50 comprises, on its periphery, primary supply boxes 16 or 56 and secondary supply boxes 18 or 58. The primary supply boxes 16 or 56 and the secondary supply boxes 18 or 58 are configured to introduce or discharge primary fluid or secondary fluid respectively into or out of the primary passages 12P or of the secondary passages 12S. The primary supply boxes 16 or 56 and the secondary supply boxes 18 or 58 are here arranged such that the primary fluid flows in the reverse direction to the secondary fluid, in other words "counter-current".

The unit 5 further comprises primary manifolds 6 and secondary manifolds 7. The primary manifolds 6 channel all or part of the primary fluid at high pressure and the secondary manifolds 7 channel all or part of the secondary fluid at low pressure.

As FIGS. 2, 3, 4 and 5 show, between two successive plates 12 or 52, a series of spacers 14 or 54 is arranged so as to form at least one respective distribution space 21P, 21S or 61P, 61S. The distribution space 21P, 21S or 61P, 61S has no spacers 14 or 54 and it is delimited by the two successive plates 12 or 52 and by the respective connection face 12 or 52, such that this distribution space 21P, 21S or 61P, 61S is fluidically connected with all or some of the primary 14P or secondary 14S channels defined by this series of spacers 14 or 54. The dimension of the distribution space in the longitudinal direction X is typically of the order of 50 mm to 100 mm.

Alternatively, one or more distribution space(s) can be without any spacer or can contain so-called distribution spacers, that is to say spacers that allow a circulation of the fluids toward the primary supply boxes 16 or 56 and/or the secondary supply boxes 18 or 58, or even can comprise a mechanical support device allowing for the brazing while maintaining a free circulation of the fluid transversely in the plane of the passage. For example, the distribution spaces can comprise a solid aluminum foam, a bar machined so as to remove a maximum of material while withstanding the pressure, pins or a steel plate with spikes.

More specifically, the distribution space 21P or 61P is fluidically connected with primary channels 14P, whereas the distribution space 21S or 61S is fluidically connected with all or some of the secondary channels 14S.

In the example of FIGS. 1 to 3, each series of spacers comprises all the spacers 14 or 54 which are arranged between the two successive plates 12 or 52. In other words, the distribution space 21P or 61P has the same discharging section as the corresponding primary passage 12P or 52*p*. The distribution space 21P or 61P can have a discharging section greater than the corresponding primary passage 12P or 52P. Similarly, the distribution space 21S or 61S has the same discharging section as the corresponding secondary passage 12S or 52S.

Moreover, the heat exchanger assembly 1 comprises an enclosure 30 which is delimited by the first connection face 12F, by the second connection face 52F and by an enclosure volume V30 which extends between the first connection face 12F and the second connection face 52F. The enclosure volume V30 is defined by enclosure walls which envelope the enclosure volume.

The enclosure 30 has primary compartments 30P and secondary compartments 30S which follow one another in the direction Y which is transversal to the stacking direction Z.

Furthermore, the heat exchanger assembly 1 comprises primary compartments 30P which are arranged in the enclosure volume V30 to channel all or part of the primary fluid between the first exchanger 10 and the second exchanger 50 through the first connection face 12F and the second connection face 52F.

Similarly, the heat exchanger assembly 1 comprises secondary compartments 30S which are distinct from the primary compartments 30P. The secondary compartments 30S are arranged in the enclosure volume V30 to channel all or part of the secondary fluid between the first exchanger 10 and the second exchanger 50 through the first connection face 12F and the second connection face 52F.

Figure 4:
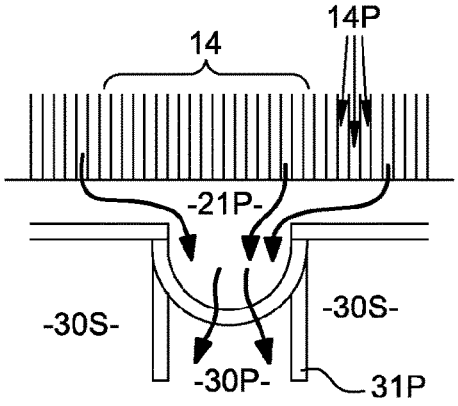
FIG. 4 is a larger scale view of the detail IV in FIG. 2.

Each primary compartment 30P is fluidically connected with two respective primary passages 12P and 52P which belong respectively to the two heat exchangers 10 and 50, so as to allow the flow of the primary fluid between the heat exchangers 10 and 50, as symbolically represented by the arrows in FIG. 2 or 4.

Figure 5:
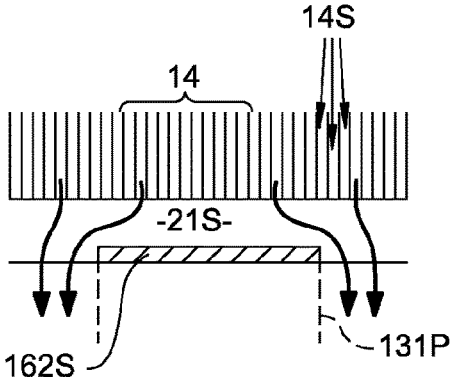
FIG. 5 is a larger scale view of the detail V in FIG. 3.

Similarly, each secondary compartment 30S is fluidically connected with two respective secondary passages 12S and 52S belonging respectively to the two heat exchangers 10 and 50, so as to allow the flow of the secondary fluid between the heat exchangers 10 and 50, as symbolically represented by the arrows in FIG. 3 or 5.

As FIG. 4 shows, the primary compartments 30P are formed by primary ducts 31P which each extend between the adjacent surfaces 11 and 51 and parallel to the stacking direction Z. As FIG. 2 shows, the primary ducts 31P are distributed at regular intervals in the direction Y which is transversal to the stacking direction Z.

The primary ducts 31P are fluidically connected with the primary passages 12P and 52P of each heat exchanger 10 or 50, so as to allow the flow of the primary fluid between the heat exchangers 10 and 50.

In the example of FIGS. 1 to 3, each secondary compartment 30S is formed by the walls of the enclosure 30 and by the walls of two successive primary ducts 31P.

As FIG. 4 shows, each primary duct 31P is in the form of a prism with rectangular base and whose generatrices are parallel to the stacking direction Z. Consequently, the walls of the primary ducts 31P are planar and parallel to the stacking direction Z.

As FIGS. 2 and 5 show, in each secondary passage 12S or 52S, a blocking member 122S or 162S is placed on the respective primary duct 131P so as to prevent the flow of secondary fluid in this primary duct 131P.

Figure 6:
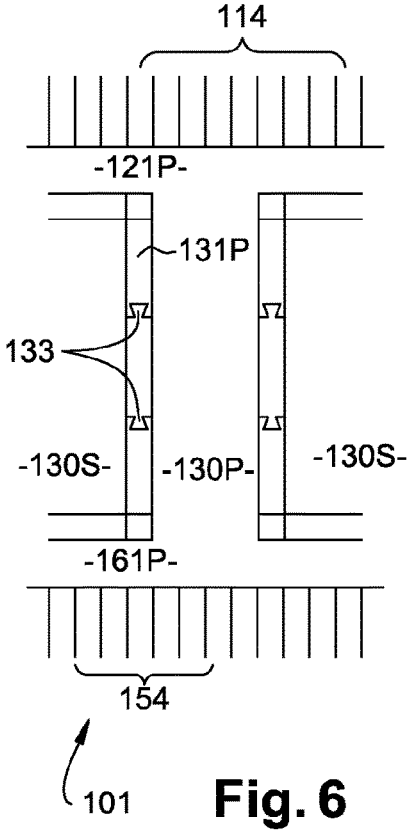
FIG. 6 is a view similar to FIG. 4 of an alternative embodiment to FIG. 4.

FIG. 6 illustrates a part of a heat exchanger assembly 101 according to a variant embodiment of the invention. Inasmuch as the heat exchanger assembly 101 is similar to the heat exchanger assembly 1, the description of the heat exchanger assembly 1 given above in relation to FIGS. 1 to 4 can be transposed to the heat exchanger assembly 101, except for the notable differences listed below.

A component of the heat exchanger assembly 101 that is identical or corresponds, by its structure or by its function, to a component of the heat exchanger assembly 1 bears the same numerical reference increased by 100. Thus, there are defined spacers 114 and 154, distribution spaces 121P and 161P, a primary compartment 130P and secondary compartments 130S and a primary duct 131P.

The heat exchanger assembly 101 differs from the heat exchanger assembly 1 in that each primary duct 131P is made up of three parts secured together by complementary forms, in this case dovetails 133.

Figure 7:
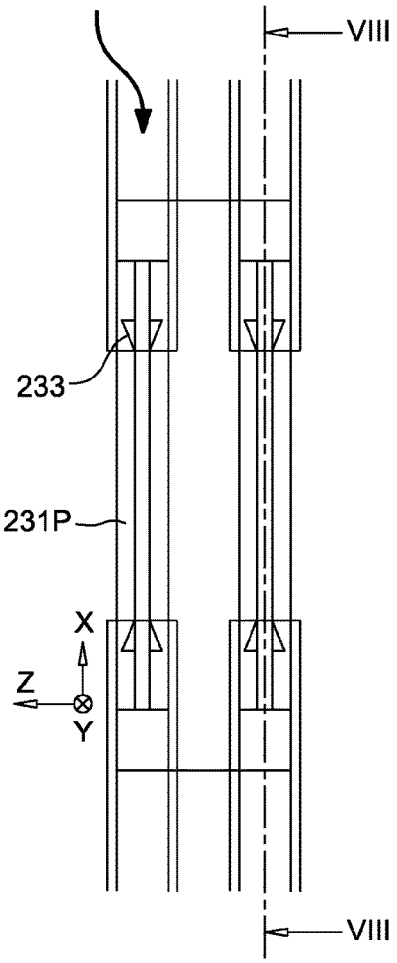
FIG. 7 is a view similar to FIG. 4 of an alternative embodiment to FIG. 4.
Figure 8:
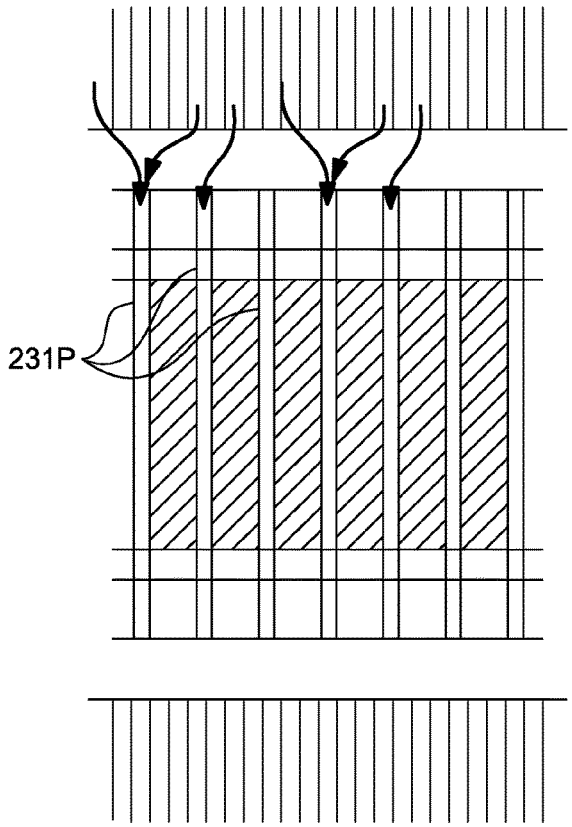
FIG. 8 is a section along the line VIII-VIII.

FIGS. 7 and 8 illustrate a part of a heat exchanger assembly which is in accordance with another variant embodiment of the invention and which differs from the heat exchanger assembly 101 in that the parts are secured by complementary forms that can define snap-fitting elements.

Figure 9:
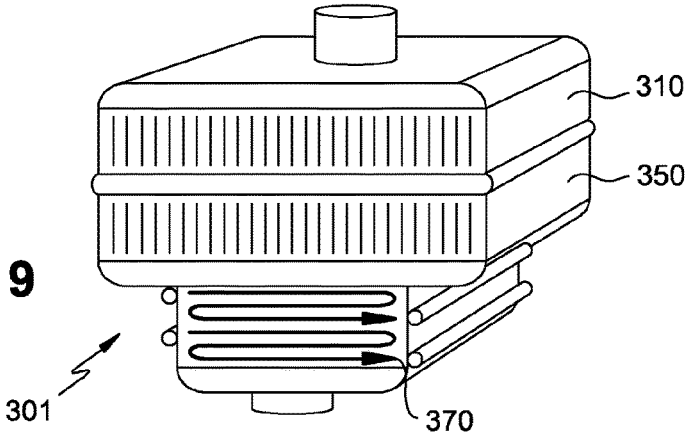
FIG. 9 is a perspective schematic view of a heat exchanger assembly according to a second embodiment of the invention.

FIG. 9 illustrates a heat exchanger assembly 301 according to a second embodiment of the invention. Inasmuch as the heat exchanger assembly 301 is similar to the heat exchanger assembly 1, the description of the heat exchanger assembly 1 given above in relation to FIGS. 1 to 4 can be transposed to the heat exchanger assembly 301, except for the notable differences listed below.

A component of the heat exchanger assembly 301 that is identical or corresponds, by its structure or by its function, to a component of the heat exchanger assembly 1 bears the same numerical reference increased by 300. Thus, heat exchangers 310 and 350 are defined.

The heat exchanger assembly 101 differs from the heat exchanger assembly 1 in that the heat exchanger assembly 101 comprises an additional heat exchanger, called sub-cooler 370. The sub-cooler 370 is fluidically connected with the heat exchanger 350.

Figure 10:
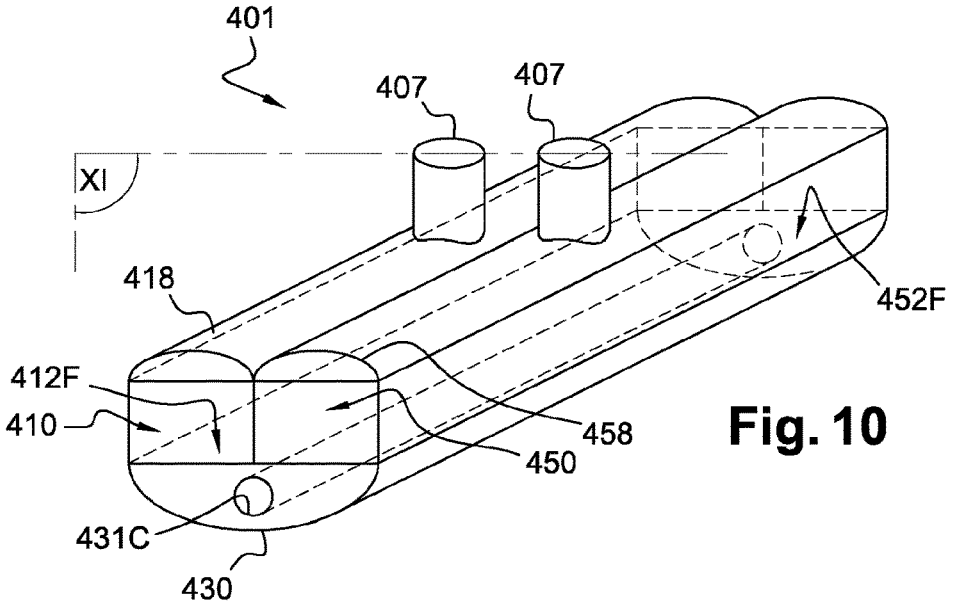
FIG. 10 is a perspective schematic view of a heat exchanger assembly according to a third embodiment of the invention.
Figure 11:
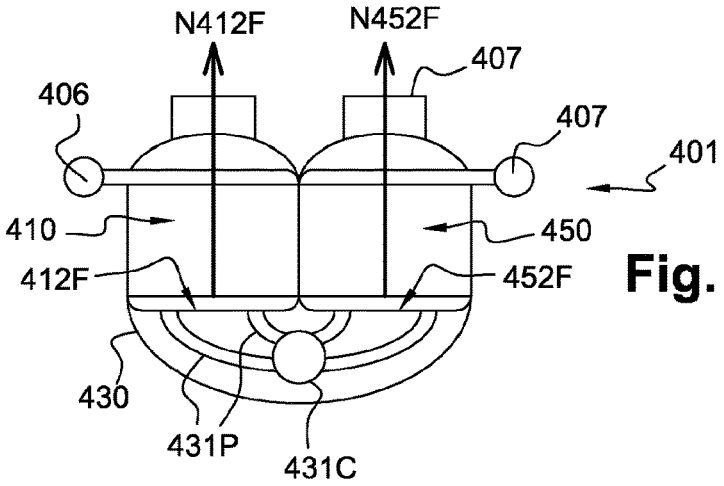
FIG. 11 is a cross section on the plane XI in FIG. 10.

FIGS. 10 and 11 illustrate a heat exchanger assembly 401 according to a third embodiment of the invention. Inasmuch as the heat exchanger assembly 401 is similar to the heat exchanger assembly 1, the description of the heat exchanger assembly 1 given above in relation to FIGS. 1 to 4 can be transposed to the heat exchanger assembly 401, except for the notable differences listed below.

A component of the heat exchanger assembly 401 that is identical or corresponds, by its structure or by its function, to a component of the heat exchanger assembly 1 bears the same numerical reference increased by 400. Thus, there are defined a first exchanger 410 and a second exchanger 450, a first connection face 412F and a second connection face 452F, an enclosure 430, primary ducts 431P, primary manifolds 406, secondary manifolds 407 and secondary supply boxes 418 or 458.

As FIGS. 10 and 11 show, the heat exchanger assembly 401 differs from the heat exchanger assembly 1, primarily in that the first exchanger 410 and the second exchanger 450 are arranged side-by-side. The first connection face 412F and the second connection face 452F are oriented in respective normal directions N412F and N452F which are parallel. Thus, the enclosure 430 and its enclosure volume are overall in the form of a half-cylinder.

Furthermore, unlike the heat exchanger assembly 1, the first connection face 412F and the second connection face 452F are arranged so as to present a common edge, as FIGS. 10 and 11 show.

Moreover, unlike the heat exchanger assembly 1, the primary ducts 431P comprise i) a longitudinal manifold 431C of tubular form with circular section, and ii) primary tubes 431T fluidically linking the manifold 431C to the first connection face 412F and to the second connection face 452F.

Furthermore, the heat exchanger assembly 401 differs from the heat exchanger assembly 1 in that the enclosure 430, and therefore the enclosure volume, forms all the secondary compartment. This secondary compartment therefore extends around the primary compartments that are formed by the primary ducts 431P. The heat exchanger assembly 401 comprises sealing means between, on the one hand, the enclosure and, on the other hand, the first connection face and the second connection face.

Figure 12:
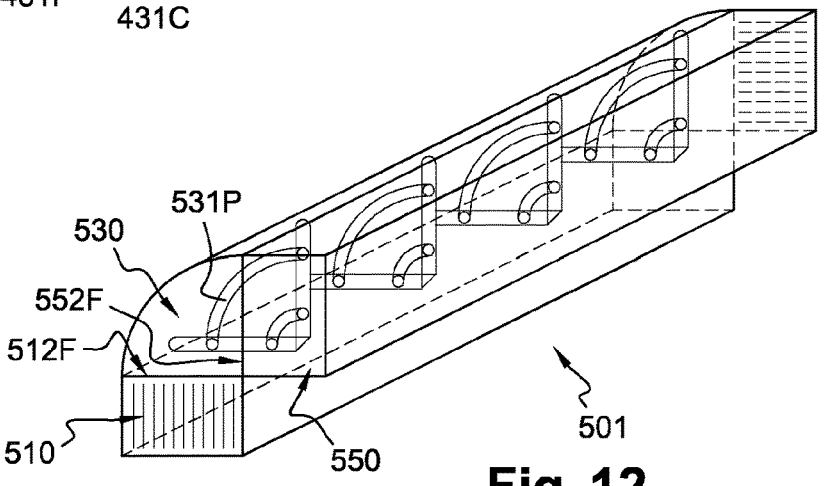
FIG. 12 is a perspective schematic view of a heat exchanger assembly according to a fourth embodiment of the invention.

FIG. 12 illustrates a heat exchanger assembly 501 according to a fourth embodiment of the invention. Inasmuch as the heat exchanger assembly 501 is similar to the heat exchanger assembly 1, the description of the heat exchanger assembly 1 given above in relation to FIGS. 1 to 4 can be transposed to the heat exchanger assembly 501, except for the notable differences listed below.

A component of the heat exchanger assembly 501 that is identical or corresponds, by its structure or by its function, to a component of the heat exchanger assembly 1 bears the same numerical reference increased by 500. Thus, there are defined a first exchanger 510 and a second exchanger 550, a first connection face 512F and a second connection face 552F, an enclosure 530 and primary ducts 531P.

As FIG. 12 shows, the heat exchanger assembly 501 differs from the heat exchanger assembly 1, primarily in that the first connection face 512F and the second connection face 552F are orthogonal to one another.

The first connection face 512F and the second connection face 552F are arranged so as to present a common edge. Thus, the enclosure 530 is overall in the form of a quarter-cylinder.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A heat exchanger assembly for forming a heat transfer unit without contact between a primary fluid and a secondary fluid, the heat exchanger assembly comprising a first exchanger and a second exchanger, wherein the heat exchanger assembly is configured to exchange heat between at least one primary fluid, and at least one secondary fluid, wherein:

each exchanger comprises a stack of several plates arranged parallel to one another in a so-called stacking direction, so as to delimit at least i) primary passages configured for the flow of primary fluid and ii) secondary passages configured for the flow of secondary fluid, the primary passages and the secondary passages following one another according to a predetermined stacking pattern, the stack of the plates of the first exchanger defines a first connection face fluidically linked to the primary passages of the first exchanger, the stack of the plates of the second exchanger defines a second connection face fluidically linked to the primary passages of the second exchanger, wherein the first exchanger and the second exchanger are arranged such that the first connection face is adjacent to the second connection face, wherein the heat exchanger assembly further comprises:

an enclosure delimited by the first connection face, by the second connection face and by an enclosure volume extending between the first connection face and the second connection face;

a plurality of primary compartments arranged in the enclosure volume to channel all or part of the primary fluid between the first exchanger and the second exchanger through the first connection face and the second connection face, wherein the primary compartments are formed by primary ducts which each extend between the first connection face and the second connection faces and parallel to the stacking direction; and a plurality of secondary compartments distinct from said plurality of primary compartments which are arranged in the enclosure volume to channel all or part of the secondary fluid between the first exchanger and the second exchanger through the first connection face and the second connection face, wherein each secondary compartment is formed by the walls of the enclosure and by the walls of two successive primary ducts.

2. The heat exchanger assembly as claimed in claim 1, in which the first connection face is overall planar and at right angles to said plates of the first exchanger, and the second connection face is overall planar and at right angles to the plates of the second exchanger.

3. The heat exchanger assembly as claimed in claim 2, in which the first connection face and the second connection face are parallel and arranged facing one another.

4. The heat exchanger assembly as claimed in claim 2, in which the first exchanger and the second exchanger are arranged side-by-side, the first connection face and the second connection face being oriented in respective normal directions which are substantially parallel, the first connection face and the second connection face being arranged so as to present an adjacent or common edge.

5. The heat exchanger assembly as claimed in claim 2, in which the first connection face and the second connection face are substantially orthogonal to one another, the first connection face and the second connection face being arranged so as to present an adjacent or common edge.

6. The heat exchanger assembly as claimed in claim 1, in which the enclosure volume forms the secondary compartment.

7. The heat exchanger assembly as claimed in claim 1, in which the first connection face is overall in the form of a rectangle whose edges are defined by the length and by the height, in the stacking direction, of the first exchanger, and in which the second connection face is overall in the form of a rectangle whose edges are defined by the length and by the height, in the stacking direction, of the second exchanger.

8. The heat exchanger assembly as claimed in claim 1, in which, for each of the exchangers, a length, which is the largest dimension of the parallel plates delimiting the fluid passages, is greater by a factor of at least four, than the height measured in the stacking direction.

9. The heat exchanger assembly as claimed in claim 1, the primary ducts being distributed with predetermined intervals in a direction that is transversal to the stacking direction, the primary ducts being fluidically connected with the primary passages of each exchanger so as to allow the flow of the primary fluid between the heat exchangers.

10. The heat exchanger assembly as claimed in claim 9, in which each primary duct is in the form of a prism with rectangular base or of a cylinder with curvilinear base and whose generatrices are parallel to the stacking direction.

11. The heat exchanger assembly as claimed in claim 9, in which each primary duct consists of at least two parts secured together by mechanical securing means.

12. The heat exchanger assembly as claimed in claim 1, in which, in each secondary passage, a blocking member is placed on the respective primary duct so as to prevent the flow of secondary fluid in said primary duct.

13. The heat exchanger assembly as claimed in claim 1, in which the primary compartments and the secondary compartments are totally or partially delimited by walls made of flexible material, the flexible material being selected from the group consisting of stainless steel, aluminum, an aluminum alloy and organic materials that are flexible at low temperature.

14. The heat exchanger assembly as claimed in claim 1, further comprising an additional exchanger, called sub-cooler, the sub-cooler being fluidically connected with one of the juxtaposed heat exchangers.

15. The heat exchanger assembly as claimed in claim 1, in which each exchanger comprises, on its periphery, primary supply boxes and secondary supply boxes which are configured to introduce or discharge primary fluid or secondary fluid respectively into or out of the primary passages or the secondary passages, the primary supply boxes and the secondary supply boxes being arranged such that the primary fluid flows in the reverse direction to the secondary fluid.

16. The heat exchanger assembly as claimed in claim 1, in which each heat exchanger is configured such that the direction of flow of the primary and secondary fluids in each exchanger is a transverse direction extending widthwise in a heat exchanger.

* * * * *